United States Patent [19]

Morris

[11] 4,086,087

[45] Apr. 25, 1978

[54] PROCESS FOR THE PREPARATION OF POWDERED METAL PARTS

[76] Inventor: Lisa Marie Morris, 24608 Chancel, Mount Clemens, Mich. 48043

[21] Appl. No.: 754,185

[22] Filed: Dec. 27, 1976

[51] Int. Cl.[2] ..... B22F 3/00; B22F 3/24

[52] U.S. Cl. ..... 75/200; 75/211; 75/212; 427/430 R; 427/435; 427/154; 427/300; 29/420.5; 148/126; 134/2

[58] Field of Search ..... 75/208, 211, 212; 427/430, 435, 154, 300; 29/420.5; 148/126

[56] References Cited

U.S. PATENT DOCUMENTS

| | | | |
|---|---|---|---|
| 2,076,381 | 4/1937 | Millner et al. | 75/200 |
| 2,155,592 | 4/1939 | Hardy | 75/200 |
| 2,655,457 | 10/1953 | Verdi | 75/200 |
| 2,897,097 | 7/1959 | Smith et al. | 75/200 |
| 3,007,822 | 11/1961 | Kaiser et al. | 75/200 |
| 3,290,124 | 12/1966 | Holtzclaw, Jr. | 75/200 |
| 3,337,336 | 8/1967 | Rao | 75/212 |
| 3,741,734 | 6/1973 | Dunham | 75/211 |
| 3,853,491 | 12/1974 | Dunham | 75/206 |
| 3,988,524 | 10/1976 | Dreyer et al. | 75/211 |

*Primary Examiner*—Brooks H. Hunt
*Attorney, Agent, or Firm*—Burton, Parker & Schramm

[57] ABSTRACT

A process of producing powdered metal parts comprising the steps:

1. Preforming powdered metal parts into a desired shape;

2. Treating said preformed part with a substance which can fill the pores of said powdered metal parts, said substance being immiscible with organic lubricants;

3. Contacting said treated metal part with a lubricant;

4. Sizing or coining the lubricated powdered metal part; and

5. Washing said powdered metal part to remove said lubricant.

Preferably the sized powdered metal part is also heat treated.

12 Claims, No Drawings

PROCESS FOR THE PREPARATION OF POWDERED METAL PARTS

BACKGROUND OF THE INVENTION

The present invention is concerned with a process of producing powdered metal parts. In particular, the process is concerned with removing the lubricants that are employed in the process of producing powdered metal parts.

During the preparation of powdered metal parts, various lubricants must be applied to the parts in order to assist in the sizing and proper shaping of the powdered metal parts. A difficulty has arisen in the field of powder metallurgy that the lubricant must be removed from proper handling and operation of the part. Due to the porosity of a powdered metal part, the lubricant has a tendency to penetrate deeply within the pores of the parts. U.S. Pat. No. 3,007,822 teaches that there is no known method for removing said oil. Therefore, when the part is subjected to heat treatment in order to cause the proper hardening of the metal, the lubricant has a tendency to ooze from the part, discolor the part, and carbonize onto the part, forming carbon scale. The carbonized substance detrimentally affects the operation of the powdered metal part and therefore must be removed by extremely costly methods such as grit blasting or to subject the part to an oxidizing atmosphere at high temperatures, which is extremely costly and in turn affects the hardening of the powdered metal part itself.

A number of patents discuss the problem of oil in powdered metal parts. U.S. Pat. No. 3,007,822 suggests that the pores of powdered metal parts be filled with an organic resin for successful plating. U.S. Pat. No. 3,290,124 suggests impregnating porous electrical discharge metal parts with plastic fillers. U.S. Pat. No. 2,155,592 teaches inserting waxlike substances into the pores of the powdered metal parts. U.S. Pat. No. 3,741,734 teaches impregnating sintered porous metal with solid additives by the liquid diffusion process. U.S. Pat. No. 3,853,491 teaches a liquid diffusion process to concentrate thoria content in filaments. U.S. Pat. No. 2,076,381 teaches porous tungsten being sintered in the presence of hydrogen saturated with water vapor to provide large crystal growth. U.S. Pat. No. 3,337,336 teaches a sintered zinc electrode being treated with a solvent water mix, which has a low dielectric constant so as to leach out impurities from amalgamated zinc anodes. U.S. Pat. No. 2,655,457 teaches hardening of sintered tungsten alloys by being quenched in water or oil. U.S. Pat. No. 2,897,097 teaches porous metal parts being filled with molten wax prior to metal plating of the part.

None of the above references suggests a convenient means for removal of a lubricant applied to a powdered metal part to assist in the sizing of said part.

SUMMARY OF THE INVENTION

The present invention is concerned with a method of preventing the lubricant employed in the formation of powdered metal parts from penetrating too deeply into the pores of said powdered metal part. The powdered metal part, prior to application of the lubricant, is contacted by a substance which can fill the pores of the powdered metal parts, preferably a substance which is immiscible liquid with the lubricant, such as water. After formation of the part, the liquid is expanded such as by heat so as to drive the lubricant out of the pores of the part.

DESCRIPTION OF PREFERRED EMBODIMENT

The present invention is concerned with a process for producing powdered metal parts comprising the steps:

1. Preforming the powdered metal part into a desired shape such as by sintering the powdered metal;
2. Treating said preformed metal part with a liquid immiscible with a lubricant;
3. Contacting said treated metal part with a lubricant;
4. Sizing the lubricated metal part; and
5. Washing said metal parts to remove the lubricant therefrom.

Additionally, one may heat-treat the sized metal part to harden said metal.

It has been found highly desirable that the powdered metal part, after being sintered in a preforming operation, is contacted with a substance which will fill the voids of the powdered metal part which will prevent the sizing lubricant from penetrating therein too deeply. Most preferably, the substance is a liquid which is immiscible with the lubricant. Most preferably, the substance is a water solution, preferably containing an anti-corrosive compound such as water soluble chromium salts.

The powdered metal parts are contacted with the water solution for a sufficient period of time for the liquid to penetrate the pores of the shaped powdered metal part. The time period for causing the water to pass into said part is primarily dependent upon the porosity of the powdered metal and upon the ability for the water to fall within the pores in a capillary manner. The time frame can be as short as one minute to as long as five hours, preferably less than one hour.

In order to increase the ability of the liquid to penetrate the pores of the powdered metal parts, it may be desirable to add a surfactant so as to decrease the surface tension and increase the capillary action of the liquid going into the pores. It is to be appreciated that only as much water is needed to prevent the lubricant from penetrating too deeply into the porous part.

The purpose of the liquid is to expand subsequently thereby driving out the lubricant. Therefore the liquid may fill the entirety of the pores or only a portion thereof, depending on the amount needed to perform the lubricant expulsion.

During the subsequent processing of the powdered metal part, it is preferred that atmospheric temperature and pressure be maintained as to permit the powdered metal part to retain the water in the pores.

Thereafter, the parts are subjected to a lubricant by merely inserting the powdered metal part into a lubricant in a known manner. Because the liquid substance fills the voids, the lubricant merely covers the perimeter or slightly penetrates the surface of the powdered metal part. The lubricant, therefore, can act far more effectively for a very little amount of the lubricant will pass within the pores due to the presence of the water therein. The powdered metal parts may be subjected to the lubricant for significant periods of time depending upon the amount of lubricity that is required.

The lubricant that may be employed is any lubricant well-known in the art such as oils that are liquid at ambient temperatures and pressures such as long chain fatty acids, as stearic acid, lard oil and the like.

During the final shaping of the powdered metal part, the lubricant assists therein so as to prevent substantial damage to the powdered metal part.

After the powdered metal part has been finally formed to the desired shape, it is washed to remove the lubricant. Because the lubricant is substantially on the surface of the powdered metal part, a routine, simple water washing can be employed. Any washing with appropriate detergent may be employed, such as a biodegradable detergent. The washing may also include the use of solvents which will assist in the removal of the lubricant.

During the washing step, the water expands thereby driving out of the pores the lubricant therein, resulting in a clean part.

After the parts have been shaped to the final configuration, they are washed at a mild heating temperature such as up to about 200° F to assist in the removal of the lubricant.

Thereafter, the powdered metal part, in order to effect the final strengthening, is subjected to a heat treatment in a two-step operation. There is a pre-heating at a temperature of about 300° F and then an additional heating up to about 1600° F or other temperature, depending upon the particular metal, to achieve the proper hardness. Thereafter the part is quenched to attain the required hardness.

The present invention is applicable to a wide variety of powdered metal, most preferably a ferrous metal such as steel and steel alloys as copper and steel and the like.

The parts to which powder metallurgy is applicable are those parts that are routinely used in the automobile and truck industry as well as other industries, such as parts for small motors as lawn mowers, seed planters and the like.

EXAMPLES

Duplicate preformed powdered metal parts comprised of metal powders having a composition of about 2% copper and 98% steel are subjected to a processing schedule of: (1) submersion into water; (2) air dried at room temperature; (3) insertion into lard oil at room temperature; (4) air dried or wiped off at room temperature; (5) wash in an aqueous detergent at about 200° F; (6) dried; (7) heated up to 250° F to determine evidence of oil. The temperatures and times of contact are indicated below in the table. In some instances, where shown, the part was preheated.

| EX. NO. | Temp. of Part | Solution Submersion Time | Air Dry Time After Soaking | Lard Oil on Part Time |
|---|---|---|---|---|
| 1. | Room | 10 Min. | 10 Min. | 10 Min. |
| 2. | Room | 10 Min. | 45 Min. | 60 Min. |
| 3. | Room | 30 Min. | 30 Min. | 30 Min. |
| 4. | Room | 30 Min. | 45 Min. | 60 Min. |
| 5. | Room | 60 Min. | 60 Min. | 60 Min. |
| 6. | Room | 60 Min. | 16 Hrs. | 16 Hrs. |
| 7. | 200° F | 10 Min. | 10 Min. | 10 Min. |
| 8. | 200° F | 30 Min. | 45 Min. | 30 Min. |
| 9. | 200° F | 40 Min. | 45 Min. | 40 Min. |

-continued

| EX. NO. | Temp. of Part | Solution Submersion Time | Air Dry Time After Soaking | Lard Oil on Part Time |
|---|---|---|---|---|
| 10. | 200° F | 60 Min. | 45 Min. | 60 Min. |
| 11. | 200° F | 60 Min. | 16 Hrs. | 16 Hrs. |
| 12. | 200° F | 120 Min. | 45 Min. | 120 Min. |

There was no visible indication of surface oil after parts were heated to a temperature of 250° F.

What is claimed is:

1. A process for producing powdered metal parts comprising the steps:

a. Preforming powdered metal parts by pressing and sintering into a desired shape;

b. Impregnating said preformed part with a liquid which is immiscible with a lubricant;

c. Contacting said impregnated metal part with a lubricant;

d. Sizing the lubricated powdered metal part; and e. Washing said powdered metal part to remove said lubricant.

2. The process of claim 1 further comprising heat-treating the sized powdered metal part to a temperature ranging from about 300° F to 1600° F.

3. The process of claim 1 wherein the liquid is an aqueous solution.

4. The process of claim 3 wherein the water solution contains water soluble salts of corrosion resistant substances which are corrosion resistant substances for the metal part.

5. The process of claim 1 wherein the powdered metal is a ferrous metal.

6. In a process for producing powdered metal parts wherein the powdered metal is preformed by pressing and sintering into a powdered metal part of a desired shape; contacted with a lubricant; and sized to a final shape, the improvement comprising:

A. Prior to contacting said shaped powdered metal part with a lubricant, impregnating said part with a liquid immiscible with the lubricant; and B. After final sizing of said part, washing said part to remove said lubricant.

7. The process of claim 6 wherein the liquid is an aqueous solution.

8. The process of claim 7 wherein the liquid solution contains a water soluble salt of a corrosion resistant substance for the part.

9. The process of claim 6 wherein the powder is comprised of a ferrous metal.

10. A method of expelling a lubricant from a powdered metal part comprising the steps of:

a. preforming a powdered metal part by pressing and sintering into a desired shape;

b. impregnating said part with a liquid immiscible with the lubricant for said part;

c. contacting said impregnated metal part with the lubricant therefor; and d. washing said powdered metal part to expel the lubricant therefrom.

11. The process of claim 10 wherein the washing step takes place at a temperature of at least 200° F.

12. The process of claim 1 further comprising heat-treating the sized powdered metal part.

* * * * *